US009777427B2

(12) United States Patent
Cuppini et al.

(10) Patent No.: US 9,777,427 B2
(45) Date of Patent: Oct. 3, 2017

(54) MACHINE AND METHOD FOR CLEANING FABRICS OR THE LIKE

(71) Applicant: F.M.B. FABBRICA MACCHINE BOLOGNA S.p.A., Sala Bolognese (Bologna) (IT)

(72) Inventors: Gabriele Cuppini, Bologna (IT); Fulvio Nuzzo, Bentivoglio (IT)

(73) Assignee: F.M.B. FABBRICA MACCHINE BOLOGNA S.P.A., Sala Bolognese (IT)

( * ) Notice: Subject to any disclaimer, the term of this patent is extended or adjusted under 35 U.S.C. 154(b) by 68 days.

(21) Appl. No.: 14/406,990

(22) PCT Filed: Jul. 17, 2013

(86) PCT No.: PCT/IB2013/055864
§ 371 (c)(1),
(2) Date: Dec. 10, 2014

(87) PCT Pub. No.: WO2014/020474
PCT Pub. Date: Feb. 6, 2014

(65) Prior Publication Data

US 2015/0184332 A1 Jul. 2, 2015

(30) Foreign Application Priority Data

Jul. 31, 2012 (IT) ..... BO2012A0418

(51) Int. Cl.
*D06F 43/02* (2006.01)
*D06F 43/00* (2006.01)
*D06F 35/00* (2006.01)

(52) U.S. Cl.
CPC ..... *D06F 43/02* (2013.01); *D06F 35/00* (2013.01); *D06F 35/006* (2013.01); *D06F 43/00* (2013.01)

(58) Field of Classification Search
CPC ..... D06F 33/00; D06F 33/02; D06F 33/04; D06F 33/06; D06F 33/08; D06F 33/10;
(Continued)

(56) References Cited

U.S. PATENT DOCUMENTS 2,573,966 A * 11/1951 Hamlin ..... D06F 43/02 210/771
5,827,329 A * 10/1998 Champeau ..... D06F 43/086 68/12.08

(Continued)

FOREIGN PATENT DOCUMENTS

DE 102009002957 11/2010

OTHER PUBLICATIONS

International Search Report and Written Opinion dated Oct. 24, 2013 from counterpart PCT App No. PCT/IB2013/055864.

*Primary Examiner* — David Cormier
(74) *Attorney, Agent, or Firm* — Shuttleworth & Ingersoll, PLC; Timothy J. Klima

(57) ABSTRACT

Described is a method for cleaning fabrics, such as garments and the like, comprising the following steps: a) preparing a compartment for containing fabrics; b) preparing a quantity of cleaning fluid in fluid communication with the containment compartment; c) inserting the fabrics in the compartment and isolating the containment compartment with respect to an outside environment; d) sucking air from the compartment, in a substantially continuous manner, for adjusting the pressure in the compartment for containing the fabrics to a pressure less than the atmospheric pressure so as to allow the evaporation of the cleaning fluid and the introduction into the compartment of the cleaning fluid in the vapor phase, for cleaning the fabrics.

19 Claims, 1 Drawing Sheet

(58) Field of Classification Search
CPC ..... D06F 35/00; D06F 35/005; D06F 35/006; D06F 39/008; D06F 43/00; D06F 43/005; D06F 43/007; D06F 43/08; D06F 43/081; D06F 43/083; D06F 43/086; D06F 43/088
See application file for complete search history.

(56) References Cited

U.S. PATENT DOCUMENTS 6,272,770 B1 8/2001 Slutsky et al.
6,849,094 B1 2/2005 North

* cited by examiner

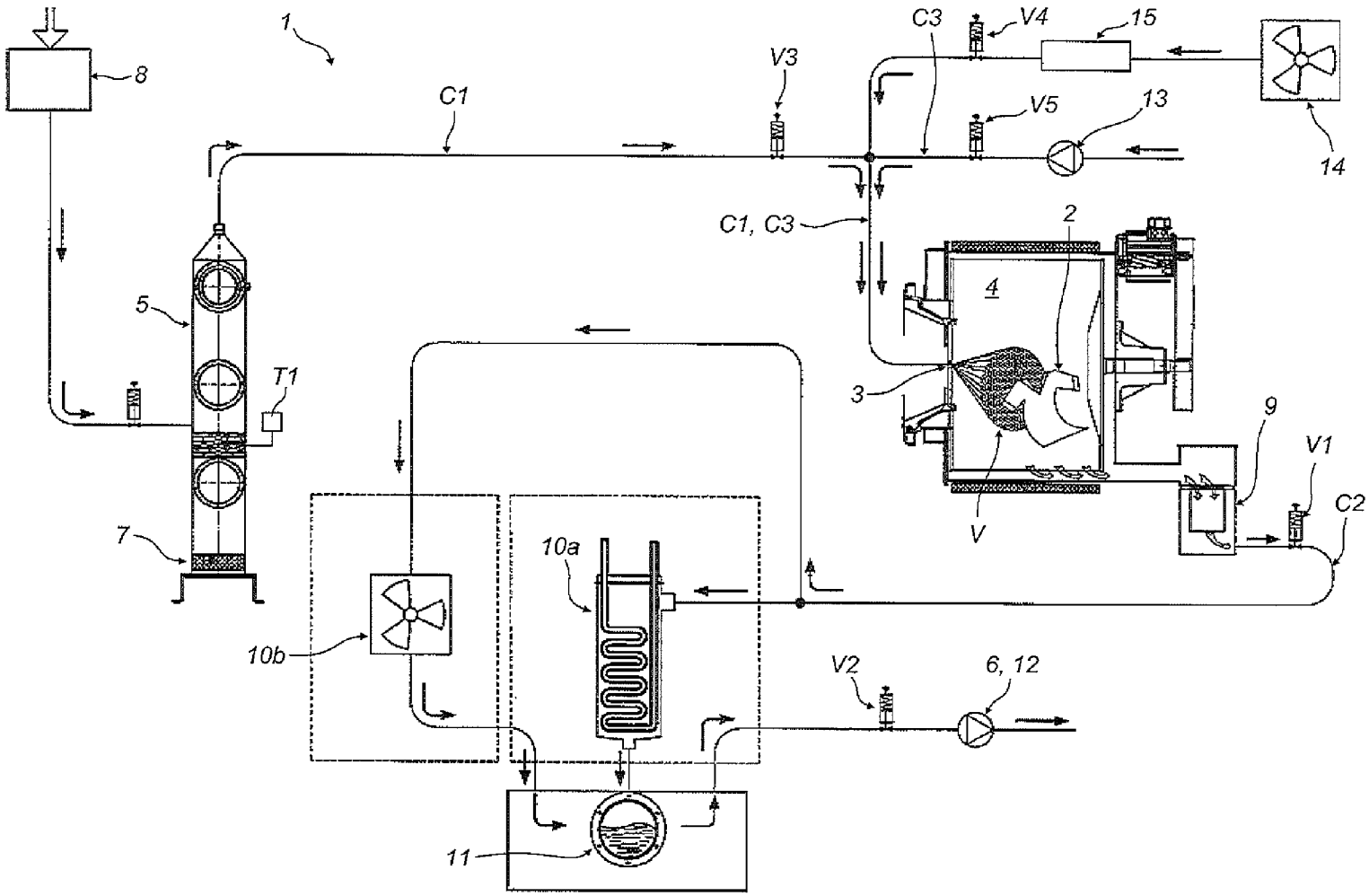
14
15
13
V4
V5
C3
V3
C1, C3
C1
1
8
5
T1
7
2
4
3
V
9
V1
C2
6, 12
V2
10a
10b
11

MACHINE AND METHOD FOR CLEANING FABRICS OR THE LIKE

This application is the National Phase of International Application PCT/82013/055864 filed Jul. 17, 2013 which designated the US.

This application claims priority to Italian Patent Application No. BO2012A000418 filed Jul. 31, 2012, which application is incorporated by reference herein.

TECHNICAL FIELD

This invention relates to a machine and a method for cleaning articles, using low temperature vapour, especially articles such as garments, linen, towels, curtains and the like (fabrics or the like).

BACKGROUND ART

Machines are known in the field of cleaning fabrics for dry cleaning comprising a rotary drum designed for housing the fabrics and a device for introducing solvent in the housing.

The machine allows the fabrics to be cleaned by a mechanical type action caused by the rotation of the drum.

A drawback of this type of machine is that of requiring a high quantity of solvent to achieve the cleaning, which must be subsequently extracted using a high speed centrifugal step.

The high quantity of solvent used in the cleaning step is such that it is difficult to fully eliminate the solvent from the fabrics at the end of the drying treatment.

Moreover, the presence of the solvent means that, in this type of machine, it is necessary to provide a device for distilling solvent, to allow the solvent to be recovered at the end of the cleaning cycle.

Another type of machine for cleaning fabrics comprises totally immersing the fabric to be cleaned in water.

A drawback of this type of system is that of using, during every cleaning cycle, a particularly high quantity of water which must be discharged into drains and it also requires the presence of drying apparatus, in which the wet garments are inserted at the end of the cleaning cycle to dry them.

DISCLOSURE OF THE INVENTION

The aim of this invention is to overcome the above mentioned disadvantages by providing a method and a machine which allow the fabrics to be cleaned in a particularly effective and environmentally-friendly manner.

Another aim of this invention is to propose a method and a machine which allow fabrics or the like to be cleaned in a particularly safe manner for human health.

Yet another aim of this invention is to propose a method and a machine which allow fabrics to be cleaned in a particularly delicate manner.

These aims are achieved according by a machine for cleaning fabrics and by a method comprising the technical characteristics described herein.

BRIEF DESCRIPTION OF THE DRAWINGS

The technical characteristics of the invention, with reference to the above-mentioned aims, are clearly described in the claims below and its advantages are more apparent from the detailed description which follows, with reference to the accompanying drawing which illustrates a preferred, non-limiting example embodiment of the invention and in which FIG. 1 shows a diagram of a machine for cleaning according to this invention.

DETAILED DESCRIPTION OF THE PREFERRED EMBODIMENTS OF THE INVENTION

With reference to FIG. 1, the numeral 1 denotes in its entirety a machine for cleaning made according to this invention.

The machine 1 for cleaning fabrics 2 is, preferably, designed for cleaning fabrics and similar articles made of fabric (curtains, clothing etc.), hereinafter also referred to as articles 2.

The machine 1 comprises a compartment 4 for containing articles 2 that can be isolated with respect to an outside environment.

It should be noted that the compartment 4 can be opened to allow the introduction inside of articles 2 to be cleaned and can be closed so as to isolate the compartment 4 from the outside environment.

Thus, the compartment 4 comprises a door (not illustrated) for allowing the introduction inside of the articles to be cleaned.

Preferably, the compartment 4 comprises a rotary drum (not illustrated), inside of which the articles 2 to be cleaned are placed.

The machine 1 further comprises a tank 5 for containing a cleaning fluid (preferably water) designed to be put in fluid communication with the compartment 4 for containing articles.

The tank 5 is fed by a further device 8 for feeding cleaning fluid, which is designed to maintain a predetermined level of cleaning fluid in the tank 5.

The containment tank 5 comprises means 7 for heating the cleaning fluid, for heating the cleaning fluid in the tank 5 to a predetermined temperature T1.

It should be noted that FIG. 1 shows with a block, labelled T1, a device (preferably comprising a thermostat) designed for regulating the predetermined temperature of the cleaning fluid in the tank 5.

The heating means 7 can comprise heating elements of an electrical type or similar devices, designed for raising the temperature of the cleaning fluid to the liquid state inside the tank 5.

The tank 5 is connected by a pipe C1 to the compartment 4 for containing articles 2.

The machine 1 comprises means 3 for introducing the cleaning fluid in the compartment for containing the articles 2 in fluid communication with the tank 5 through the pipe C1.

The introduction means 3 can comprise nozzles or diffusers, designed for introducing the cleaning fluid in the vapour phase inside the containment compartment, preferably directed on the articles to be cleaned.

According to the invention, the machine 1 comprises suction means 6, that can be connected to the compartment 4 for containing the articles 2 to impose in the compartment 4 and tank 5 a pressure P1 less than atmospheric pressure, so as to evaporate the cleaning fluid inside the tank 5 and allow the introduction into the containment compartment 4 of cleaning fluid in the form of vapour V.

Preferably, the cleaning fluid comprises water, even more preferably demineralised water.

Preferably, the heating means 7 heat the water to a temperature of between 45° C. and 85° C.

Preferably, the suction means 6 impose in the containment compartment 4 a pressure P1 of between 10 and 100 millibars (1000-10000 Pa).

Described below is the suction circuit C2, that is, the connection of the suction means 6 to the containment compartment 4, starting from the containment compartment 4.

The suction circuit C2 preferably comprises a device 9 for retaining the dirt, known as "hair trap" in the jargon of the trade, having the purpose of retaining the dirt (for example, filaments detached from the clothing during cleaning).

Downstream of the dirt retaining device 9 the circuit C2 comprises a condenser device 10*a*, 10*b*, designed for condensing (that is, favouring the passage from the vapour phase to the liquid phase) the cleaning fluid contained in the air extracted from the compartment 4.

It should be noted that the condensers 10*a*, 10*b* define, more generally, means for cooling the air extracted from the compartment 4: it should be noted that the air, extracted from the compartment 4, also comprises cleaning fluid in the vapour phase V.

The example illustrated shows two condensers 10*a*, 10*b*, positioned in parallel to each other: a first condenser 10*a* and a second condenser 10*b*.

Preferably, one 10*b* of the two condensers 10*a*, 10*b* condenses the cleaning fluid by air cooling whilst the other condenser 10*a* uses a cooling fluid.

Downstream of the condenser 10*a*, 10*b* there is a device 11 for collecting the condensed cleaning fluid.

The cleaning fluid recovered in the collection device 11 is not re-used, but disposed of externally.

Moreover, a vacuum pump 12 is positioned in the circuit C2 downstream of the collection device 11.

It should be noted that the vacuum pump 12 defines the above-mentioned suction means 6.

It should also be noted that the vacuum pump 12 sucks air from the compartment 4 to release it in the surrounding environment.

It should be noted that in the suction circuit C2 there are two closure valves: a first valve V1 is interposed between the device 9 for removing the dirt and a further valve V2 is interposed between the collection device 11 and the vacuum pump 12.

The machine 1 also comprises a circuit C3 for introducing a detergent.

In that circuit there is a valve V5 to allow the detergent to be placed in communication with the compartment 4, and a pump 13, for allowing the introduction of the detergent.

It should be noted that, according to this aspect, the detergent is mixed with the cleaning fluid in the vapour phase V.

The detergent is introduced into the containment compartment 4, mixed with the cleaning fluid in the vapour phase V, if it is necessary to clean particularly dirty garments.

The operation of the machine 1 and the method according to this invention are described below, with reference to a cleaning cycle.

The start-up of the suction means 6, with the valves V1, V2 and V3 open, causes the suction of air in a substantially continuous manner from the compartment 4.

The suction causes a lowering (adjustment) of the pressure in the compartment 4.

The pressure in the compartment 4 is brought, preferably, to a value of between 10 and 100 millibars.

It should also be noted be noted that, according to the method, the cleaning fluid present inside the tank 5 is heated to a predetermined temperature T1, which corresponds to an evaporation of the cleaning fluid at the pressure P1 present (adjusted) inside the compartment 4 during the suction step.

It should be noted that the suction of the air from the compartment 4 causes a predetermined pressure P1 inside the compartment 4 and in the tank 5 in communication with the compartment 4, less than atmospheric pressure; this causes the evaporation of the cleaning fluid and the introduction (suction) into the compartment 4 of the cleaning fluid in the vapour phase V for cleaning the articles 2.

In effect, the temperature T1 of the cleaning fluid in the tank 5 is equal to or less than the saturation temperature of the cleaning fluid at the pressure P1 adjusted (caused) in the compartment 4 and in the tank 5: this allows, advantageously, the generation of vapour V inside the tank 5.

Preferably, the vapour V inside the tank 5 is a vapour of the saturated humid type.

Preferably, the temperature T1 is between 45° C. and 85° C.

It should be noted that the vapour, introduced into the compartment 4 in contact with the articles, allows a particularly effective and delicate cleaning of the fabrics.

In effect, the combination of the rotation of the drum containing the articles and the low temperature vapour ensures a particularly optimum cleaning.

It should also be noted that, according to another aspect, the machine 1 comprises a circuity for introducing air for removing residual humidity from the garments.

This circuit comprises means 14 for introducing air (preferably a fan) and means 15 for heating air.

The air introducing means 14 and the air heating means 15 are activated at the end of the cleaning cycle, to allow the removal of the residual humidity from the cleaned garments.

A valve V4 allows the air introducing circuit to be isolated from the compartment 4.

The compartment 4 can be equipped with heating (anti-condensing) elements which prevent the condensation of the vapour on the walls of the compartment 4.

These heating elements are advantageously useful when dealing with delicate garments: in this case the vapour must have a particularly low temperature so as not to damage the garments, and the presence of the heating elements will prevent the vapour cooling and condensing on the walls of the compartment 4.

It should be noted that the heating elements define, more generally, means for heating the compartment 4, designed to heat the compartment 4 for preventing condensation of the vapour on the walls of the compartment 4.

It should be noted that the machine and the cleaning method according to this invention allow garments to be cleaned in a particularly effective manner.

In this regard, it should be noted that the low temperature vapour does not damage the fabrics, unlike what would occur in the case of particularly high temperature vapour.

Moreover, the step of removing the residual humidity is generally eliminated, as the garment is almost free of humidity at the end of the cleaning cycle.

A further advantage of the method and the machine according to this invention is that it makes the cleaning possible even without the use of a solvent, which prevents the presence of solvent residue on the garments cleaned, thus reducing the risk for human health.

According to a further aspect, the machine and method also allow the cleaning of fabrics treated with solvent.

Advantageously, according to this aspect, the low temperature vapour allows the residual solvent present on the fabrics to be removed in a particularly effective manner and to dry the fabrics: in this way the fabrics can be worn by the user without any risk as the solvent has been removed.

The invention described above is susceptible of industrial application and may be modified and adapted in several ways without thereby departing from the scope of the inventive concept. Moreover, all the details of the invention may be substituted for technically equivalent elements.

The invention claimed is:

1. A method for cleaning fabrics, comprising:

a) preparing a containment compartment for containing the fabrics;

b) preparing a quantity of cleaning fluid in a liquid state in a container in fluid communication with the containment compartment;

c) inserting the fabrics in a dirty condition in the containment compartment and isolating the containment compartment with respect to an outside environment, starting a cleaning phase of the fabrics in the dirty condition by sucking air from the containment compartment, in a substantially continuous manner, for adjusting a pressure in the containment compartment and in the container to a pressure less than atmospheric pressure to cause evaporation of the cleaning fluid and introduction of the cleaning fluid in a vapor phase into the containment compartment to clean the fabrics by using the cleaning fluid in the vapor phase to flow through the fabrics to remove contaminants causing the dirty condition from the fabrics, wherein the cleaning fluid consists of water prior to the evaporation.

2. The method for cleaning fabrics according to claim 1, wherein the sucking air comprises extracting air from the containment compartment for releasing it into the outside environment.

3. The method for cleaning fabrics according to claim 2, wherein the sucking air step comprises cooling the air extracted from the containment compartment, for allowing a condensation of the cleaning fluid contained in the sucked air.

4. The cleaning method according to claim 3, and further comprising disposing of the condensed cleaning fluid.

5. The method for cleaning fabrics according to claim 1, and further comprising heating the cleaning fluid to a predetermined temperature, which corresponds to an evaporation temperature of the cleaning fluid at the adjusted pressure inside the containment compartment during the sucking air step.

6. The method for cleaning fabrics according to claim 5, wherein the predetermined temperature is between 45° C. and 85° C.

7. The method for cleaning fabrics according to claim 5, wherein the sucking air step comprises introducing a detergent into the containment compartment for mixing with the cleaning fluid in the vapor phase for improving the cleaning of the fabrics.

8. The method for cleaning fabrics according to claim 7, wherein the adjusted pressure in the containment compartment is between 1000 and 10000 Pascals.

9. The method for cleaning fabrics according to claim 8, wherein the cleaning fluid in the vapor phase introduced into the containment compartment is a saturated humid vapor.

10. The method for cleaning fabrics according to claim 9, and further comprising exposing the fabrics to the cleaning fluid in the vapor phase only after inserting the fabrics in the containment compartment and isolating the containment compartment with respect to the outside environment.

11. The method for cleaning fabrics according to claim 5, wherein the adjusted pressure in the containment compartment is between 1000 and 10000 Pascals.

12. The method for cleaning fabrics according to claim 11, wherein the cleaning fluid in the vapor phase introduced into the containment compartment is a saturated humid vapor.

13. The method for cleaning fabrics according to claim 12, and further comprising exposing the fabrics to the cleaning fluid in the vapor phase only after inserting the fabrics in the containment compartment and isolating the containment compartment with respect to the outside environment.

14. The method for cleaning fabrics according to claim 5, wherein the cleaning fluid in the vapor phase introduced into the containment compartment is a saturated humid vapor.

15. The method for cleaning fabrics according to claim 5, and further comprising exposing the fabrics to the cleaning fluid in the vapor phase only after inserting the fabrics in the containment compartment and isolating the containment compartment with respect to the outside environment.

16. The method for cleaning fabrics according to claim 1, wherein the sucking air step comprises introducing a detergent into the containment compartment for mixing with the cleaning fluid in the vapor phase for improving the cleaning of the fabrics.

17. The method for cleaning fabrics according to claim 1, wherein the adjusted pressure in the containment compartment is between 1000 and 10000 Pascals.

18. The method for cleaning fabrics according to claim 1, wherein the vapor introduced into the containment compartment is a saturated humid vapor.

19. The method for cleaning fabrics according to claim 1, and further comprising exposing the fabrics to the cleaning fluid in the vapor phase only after inserting the fabrics in the containment compartment and isolating the containment compartment with respect to the outside environment.

* * * * *